US007343003B2

(12) United States Patent
Li

(10) Patent No.: US 7,343,003 B2
(45) Date of Patent: Mar. 11, 2008

(54) X-RAY DIAPHRAGM, X-RAY IRRADIATOR, AND X-RAY IMAGING APPARATUS

(75) Inventor: Yuqing Li, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 0 days.

(21) Appl. No.: 11/297,279

(22) Filed: Dec. 8, 2005

(65) Prior Publication Data

US 2006/0126793 A1 Jun. 15, 2006

(30) Foreign Application Priority Data

Dec. 9, 2004 (CN) ..... 2004 1 0100388

(51) Int. Cl.
*G21K 1/02* (2006.01)

(52) U.S. Cl. ..... 378/149; 378/150; 378/151; 250/505.1

(58) Field of Classification Search ..... 378/145, 378/147–152, 161; 250/505.1, 515.1, 363.1
See application file for complete search history.

(56) References Cited

U.S. PATENT DOCUMENTS 2,844,736 A * 7/1958 Johns et al. ..... 378/152
2,959,680 A * 11/1960 Green ..... 378/152
4,573,186 A 2/1986 Reinhold
4,641,335 A 2/1987 Hahn
6,292,527 B1 9/2001 Guendel
6,343,109 B2 1/2002 Doubrava et al.
6,411,671 B2 6/2002 Bruder et al.
6,597,430 B1 7/2003 Nishi et al.

FOREIGN PATENT DOCUMENTS

JP 04-267041 9/1992

* cited by examiner

*Primary Examiner*—Jurie Yun
(74) *Attorney, Agent, or Firm*—Armstrong Teasdale LLP

(57) ABSTRACT

An X-ray diaphragm including plural sets of X-ray absorbing plates, each of the plural sets including four of X-ray absorbing plates, the four X-ray absorbing plates in each of the plural sets being arranged such that two of the four plates and the other two are positioned respectively in two directions perpendicular to each other to define a quadrangular aperture and that adjacent ones thereof respectively overlap each other partially at four corners of the aperture, the apertures in the plural sets of X-ray absorbing plates being coaxial and analogous apertures positioned and increasing in size in order in an X-ray irradiating direction, and a support device for supporting the plural sets of the plates such that the plates located on the same sides in the plural sets are supported respectively by the support device throughout the plural sets.

20 Claims, 2 Drawing Sheets

X-RAY DIAPHRAGM, X-RAY IRRADIATOR, AND X-RAY IMAGING APPARATUS

CROSS REFERENCE TO RELATED APPLICATIONS

This application claims the benefit of Chinese Application No. 200410100388.9 filed Dec. 9, 2004.

BACKGROUND OF THE INVENTION

The present invention relates to an X-ray diaphragm, an X-ray irradiator and an X-ray imaging apparatus. Particularly, the present invention is concerned with an X-ray diaphragm for forming an X-ray beam of a quadrangular pyramid shape with an X-ray focal point as a vertex, as well as an X-ray irradiator and an X-ray imaging apparatus both provided with the X-ray diaphragm.

In an X-ray irradiator there is used an X-ray irradiator for forming an X-ray beam of a quadrangular pyramid shape with an X-ray focal point as a vertex. The X-ray diaphragm comprises a first diaphragm close to an X-ray tube and a second diaphragm spaced away from the X-ray tube. An X-ray beam of a quadrangular pyramid shape is formed by making an aperture of the first diaphragm small and that of the second diaphragm large (see, for example, Patent Literature 1).

[Patent Literature 1]

Japanese Unexamined Patent Publication No. Hei 4(1992)-267041 (pages 3-4, FIGS. 1-3)

In such an X-ray diaphragm as the above construction wherein two diaphragms are used to form an X-ray beam of a quadrangular pyramid shape, it is necessary that the two diaphragms be interlocked for adjusting the spread of an X-ray beam, thus resulting in the construction being complicated.

SUMMARY OF THE INVENTION

Therefore, it is an object of the present invention to provide an X-ray diaphragm of a simple construction able to form an X-ray beam of a quadrangular pyramid shape, as well as an X-ray irradiator and an X-ray imaging apparatus both provided with the X-ray diaphragm.

In one aspect of the present invention for solving the abovementioned problem there is provided an X-ray diaphragm comprising plural sets of X-ray absorbing plates, each of the plural sets comprising four of the X-ray absorbing plates, the four X-ray absorbing plates in each of the plural sets being arranged in such a manner that two of the four plates and the other two are positioned respectively in two directions perpendicular to each other so as to be respectively opposed to each other at end faces thereof to define a quadrangular aperture and that adjacent ones thereof respectively overlap each other partially at four corners of the aperture, the apertures in the plural sets of X-ray absorbing plates being coaxial and analogous apertures positioned and increasing in size in order in an X-ray irradiating direction; and support means for supporting the plural sets of the plates in such a manner that the plates located on the same sides in the plural sets are supported respectively by the support means throughout the plural sets.

In another aspect of the present invention for solving the abovementioned problem there is provided an X-ray irradiator for radiating X-rays through an X-ray diaphragm and a collimator, the X-rays being generated by an X-ray tube, the X-ray diaphragm comprising plural sets of X-ray absorbing plates, each of the plural sets comprising four of the X-ray absorbing plates, the four X-ray absorbing plates in each of the plural sets being arranged in such a manner that two of the four plates and the other two are positioned respectively in two directions perpendicular to each other so as to be respectively opposed to each other at end faces thereof to define a quadrangular aperture and that adjacent ones thereof respectively overlap each other partially at four corners of the aperture, and the apertures in the plural sets of X-ray absorbing plates being coaxial and analogous apertures positioned and increasing in size in order in an X-ray irradiating direction.

In a further aspect of the present invention for solving the abovementioned problem, there is provided an X-ray imaging apparatus for photographing a radioscopic image by radiating X-rays to a subject through an X-ray diaphragm and a collimator, the X-rays being generated by an X-ray tube, the X-ray diaphragm comprising plural sets of X-ray absorbing plates, each of the plural sets comprising four of the X-ray absorbing plates, the four X-ray absorbing plates in each of the plural sets being arranged in such a manner that two of the four plates and the other two are positioned respectively in two directions perpendicular to each other so as to be respectively opposed to each other at end faces thereof to define a quadrangular aperture and that adjacent ones thereof respectively overlap each other partially at four corners of the aperture, the apertures in the plural sets of X-ray absorbing plates being coaxial and analogous apertures positioned and increasing in size in order in an X-ray irradiating direction; and support means for supporting the plural sets of the plates in such a manner that the plates located on the same sides in the plural sets are supported respectively by the support means throughout the plural sets.

For simplifying the construction of the support means it is preferable that the support means are support rods.

The X-ray diaphragm according to the present invention comprises plural sets of X-ray absorbing plates, each of the plural sets comprising four of the X-ray absorbing plates, the four X-ray absorbing plates in each of the plural sets being arranged in such a manner that two of the four plates and the other two are positioned respectively in two directions perpendicular to each other so as to be respectively opposed to each other at end faces thereof to define a quadrangular aperture and that adjacent ones thereof respectively overlap each other partially at four corners of the aperture, the apertures in the plural sets of X-ray absorbing plates being coaxial and analogous apertures positioned and increasing in size in order in an X-ray irradiating direction; and support means for supporting the plural sets of the plates in such a manner that the plates located on the same sides in the plural sets are supported respectively by the support means throughout the plural sets. Thus, it is possible to provide the X-ray diaphragm of such a simple construction able to form an X-ray beam of a quadrangular pyramid shape, as well as an X-ray irradiator and an X-ray imaging apparatus both provided with the X-ray diaphragm.

Further objects and advantages of the present invention will be apparent from the following description of the preferred embodiments of the invention as illustrated in the accompanying drawings.

DETAILED DESCRIPTION OF THE INVENTION

Figure 1:
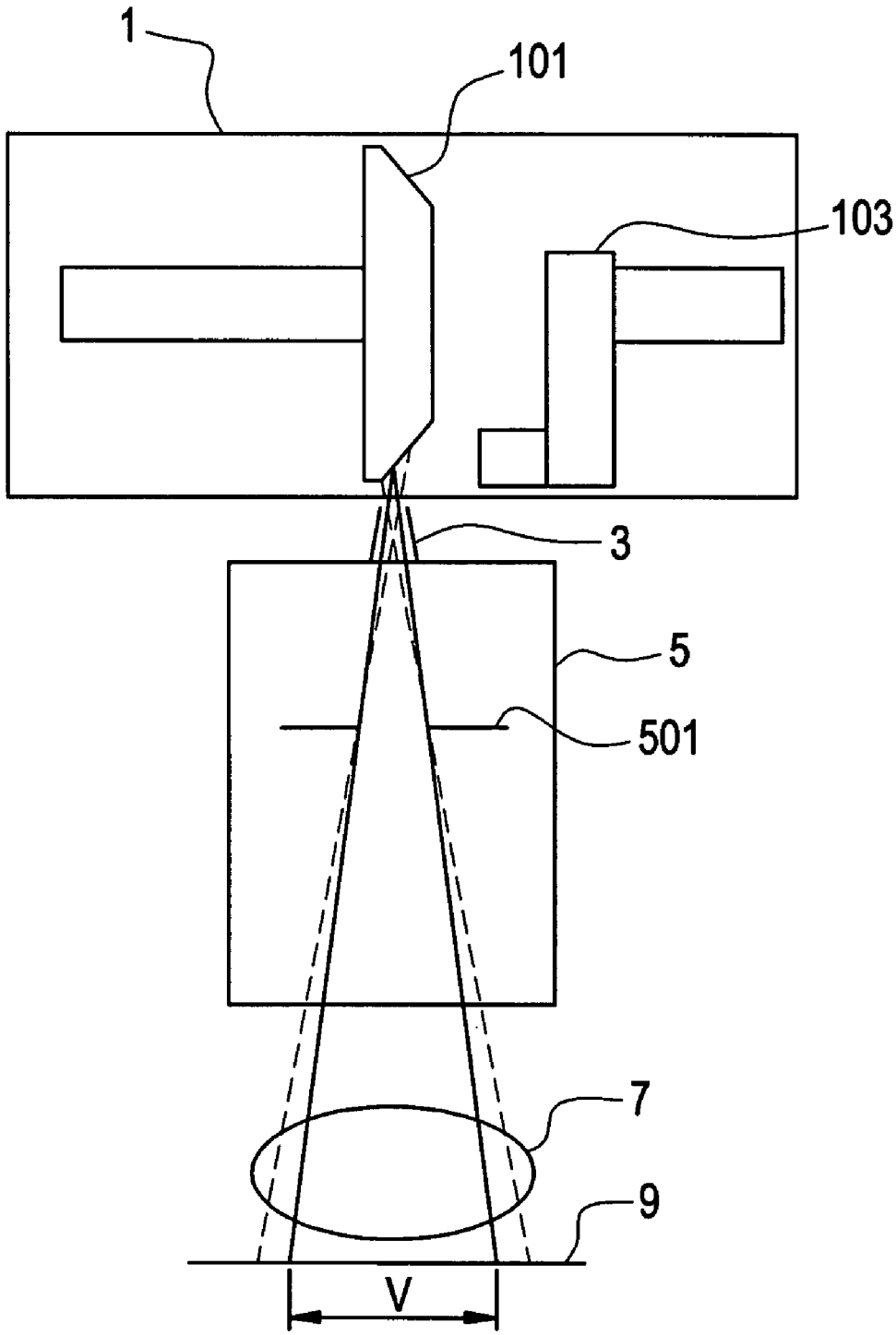
FIG. 1 illustrates a schematic construction of an X-ray imaging apparatus.

The best mode for carrying out the present invention will be described in detail hereinunder with reference to the drawings. The present invention is not limited to the best mode for carrying out the invention. FIG. 1 shows a schematic construction of an X-ray imaging apparatus. This apparatus is an example of the best mode for carrying out the present invention. With the construction of this apparatus, an example of the best mode for carrying out the present invention with respect to the X-ray imaging apparatus of the invention is shown.

In the X-ray imaging apparatus, as shown in the same figure, X-rays generated by an X-ray tube 1 are diaphragmed by an X-ray diaphragm 3, then are collimated by a blade 501 in a collimator 5 and radiated toward a subject 7, and the transmitted X-rays are detected by a detector 9.

The portion consisting of the X-ray tube 1, the X-ray diaphragm 3 and the collimator 5 is an example of the best mode for carrying out the present invention. With the construction of this apparatus, an example of the best mode for carrying out the present invention with respect to the X-ray irradiator is shown.

The X-ray tube 1 has an anode 101 and cathode 103. X-rays are generated from impingement points of electrons emitted from the cathode 103 toward the anode 101.

The X-rays thus generated are radiated to the subject 7 through both the X-ray diaphragm 3 and the collimator 5. The X-ray diaphragm 3 is constructed of an X-ray absorbing material such as, for example, lead, tungsten (W), or molybdenum (Mo). This is also the case with the blade 501 in the collimator 5.

An X-ray irradiation field V is determined by an aperture of the blade 501 in the collimator 5. The X-ray diaphragm 3 forms the X-rays generated from the X-ray tube 1 into a beam of a quadrangular pyramid shape with an X-ray focal point on the anode 101 as a vertex, thereby decreasing the amount of X-rays radiated to an area other than the irradiation field as indicated by broken lines, which is based on X-rays generated from other points than the focal point.

X-rays generated from other points than the focal point are also called off-focal radiation. Off-focal radiation occurs much particularly in a direction perpendicular to the axis of the X-ray tube 1, i.e., in a direction perpendicular to the paper surface. Such off-focal radiation is diminished effectively by the X-ray diaphragm 3. The X-ray diaphragm 3 is also called off-focal blade.

In the collimator 5, an aperture of the blade 501 is variable, whereby the irradiation field V of X-rays is adjusted. A diaphragming quantity of the X-ray diaphragm 3 is also adjusted in interlock with the aperture adjustment of the blade 501. More particularly, the diaphragming quantity is decreased as the irradiation field V becomes larger to increase the divergence angle of the quadrangular pyramid-shaped beam, while it is increased as the irradiation field V becomes smaller to decrease the divergence angle of the quadrangular pyramid-shaped beam.

By thus interlocking the aperture adjustment of the blade 501 with the diaphragming quantity adjustment of the X-ray diaphragm, the blade 501 may be a blade of a small X-ray absorption area. This is for the following reason.

In the case where the irradiation field adjustment is made by only adjusting the aperture of the blade 501, the diaphragming quantity of the X-ray diaphragm 3 is fixed to the minimum value and the divergence angle of the quadrangular pyramid-shaped beam is fixed to an angle which can cope with the maximum irradiation field. Therefore, for obtaining a minimum irradiation field under such conditions, the blade 501 must be one having a large X-ray absorption area. However, this is not required when the divergence angle of the quadrangular pyramid-shaped beam is changed by adjusting the diaphragm in accordance with the irradiation field.

The X-ray diaphragm 3 and the collimator 5 are integrally rotatable in a plane parallel to the axis of the X-ray tube 1, i.e., in a plane perpendicular to the paper surface, whereby the irradiation field F of X-rays can be rotated in the plane parallel to the axis of the X-ray tube.

Figure 2:
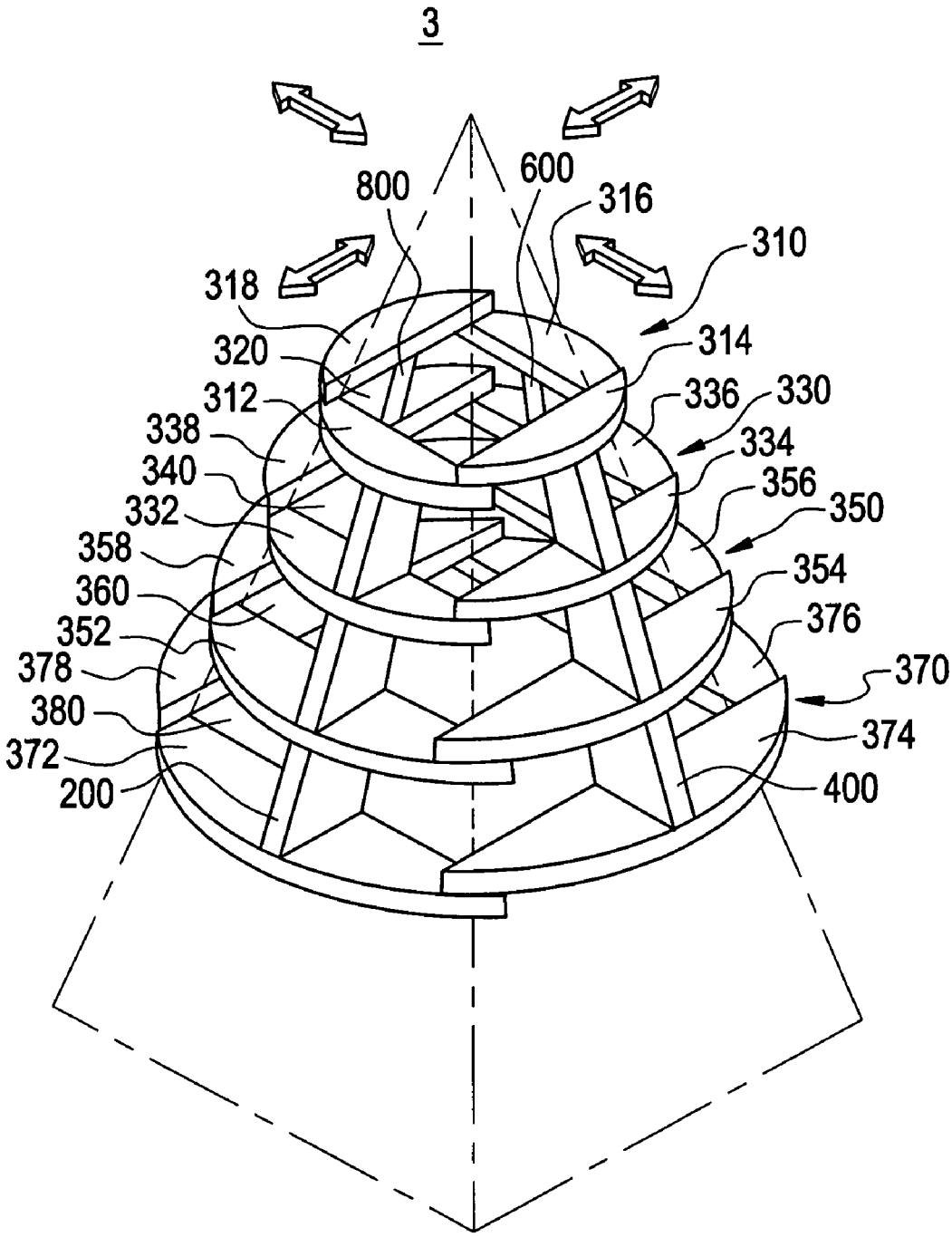
FIG. 2 illustrates an appearance of an X-ray diaphragm.

FIG. 2 shows the construction of the X-ray diaphragm 3. The X-ray diaphragm 3 is an example of the best mode for carrying out the present invention. With the construction of this device, an example of the best mode for carrying out the present invention with respect to the X-ray diaphragm is shown.

As shown in the same figure, the X-ray diaphragm 3 has four plate groups 310, 330, 350, and 370. The four plate groups 310, 330, 350, and 370 are arranged in order in an X-ray irradiating direction. The number of plate groups is not limited to four, but may be any other suitable plural number. Although the following description assumes that the number of groups is four, the same is true of the case where the number of groups is any other plural number.

The plate group 310 is made up of four plates 312, 314, 316, and 318. The plate group 330 is made up of four plates 332, 334, 336, and 338. The plate group 350 is made up of four plates 352, 354, 356, and 358. The plate group 370 is made up of four plates 372, 374, 376, and 378. All of these plates are X-ray absorbing plates.

In the plate group 310, of the plates 312, 314, 316, and 318, end faces of the plates 312 and 316 are opposed to each other and likewise end faces of the plates 314 and 318 are opposed to each other respectively in two directions perpendicular to each other so as to form a quadrangular aperture 320. Of the plates 312, 314, 316, and 318, adjacent ones, i.e., the plates 312 and 314, the plates 314 and 316, the plates 316 and 318, and the plates 318 and 312, overlap respectively partially at the four corners of the aperture 320.

In the plate group 330, of the plates 332, 334, 336, and 338, end faces of the plates 332 and 336 are opposed to each other and likewise end faces of the plates 334 and 338 are opposed to each other respectively in two directions perpendicular to each other so as to form a quadrangular aperture 340. Of the plates 332, 334, 336, and 338, adjacent ones, i.e., the plates 332 and 334, the plates 334 and 336, the plates 336 and 338, and the plates 338 and 332, overlap respectively partially at the four corners of the aperture 340.

In the plate group 350, of the plates 352, 354, 356, and 358, end faces of the plates 352 and 356 are opposed to each other and likewise end faces of the plates 354 and 358 are opposed to each other respectively in two directions perpendicular to each other so as to form a quadrangular aperture 360. Of the plates 352, 354, 356, and 358, adjacent ones, i.e., the plates 352 and 354, the plates 354 and 356, the plates 356 and 358, and the plates 358 and 352, overlap respectively partially at the four corners of the aperture 360.

In the plate group 370, of the plates 372, 374, 376, and 378, end faces of the plates 372 and 376 are opposed to each other and likewise end faces of the plates 374 and 378 are opposed to each other respectively in two directions perpendicular to each other so as to form a quadrangular aperture 380. Of the plates 372, 374, 376, and 378, adjacent ones, i.e., the plates 372 and 374, the plates 374 and 376, the plates 376 and 378, and the plates 378 and 372, overlap respectively partially at the four corners of the aperture 380.

The apertures 320, 340, 360, and 380 formed by the plate groups 310, 330, 350, and 370, respectively, are coaxial and analogous apertures which become larger in size in order in the X-ray irradiating direction. Consequently, as indicated with dot-dash lines, X-rays passing through the apertures 320, 340, 360, and 380 become a quadrangular pyramid-shaped X-ray beam with an X-ray focal point as a vertex.

In all of the plates groups 310, 330, 350, and 370, the plates located on the same sides, i.e., the plates 312, 332, 352, and 372, the plates 314, 334, 354, and 374, the plates 316, 336, 356, and 376, and the plates 318, 338, 358, and 378, are supported by support rods 200, 400, 600, and 800, respectively, throughout all of the plate groups.

Thus, the plates 312, 332, 352, and 372, the plates 314, 334, 354, and 374, the plates 316, 336, 356, and 376, and the plates 318, 338, 358, and 378, are rendered integral respectively throughout all of the plate groups to constitute four plate units.

The four plate units are actuated each independently by means of suitable actuators and are displaceable in directions in which the distance between end faces of opposed plates is varied, as indicated with arrows. The displacement of the plate units is performed while a proportional relation among the four apertures is maintained. As a result, the divergence angle of the quadrangular pyramid-shaped X-ray beam is adjusted.

Such an X-ray diaphragm is simplified in its construction because such two interlocked diaphragms as in the prior art are not used. Moreover, of the four plates in each plate group, adjacent ones overlap partially at the four corners of the aperture defined by the plates, there is no fear of leakage of X-rays from those overlapping portions. Further, since the four plates in each plate group are wide, there is no gap between adjacent plate groups when seen from the X-ray tube 1 side, with with no fear of X-ray leakage therefrom.

Therefore, even when the X-ray diaphragm 3 and the collimator 5 are rotated in a plane parallel to the axis of the X-ray tube 1, causing the irradiation field to turn by an angle of 45° to 90°, off-focal radiation can be diminished always in a satisfactory manner regardless of the rotation angle.

Many widely different embodiments of the invention may be configured without departing from the spirit and the scope of the present invention. It should be understood that the present invention is not limited to the specific embodiments described in the specification, except as defined in the appended claims.

The invention claimed is:

1. An X-ray diaphragm comprising:

plural sets of X-ray absorbing plates, each of the plural sets comprising four of said X-ray absorbing plates, the four X-ray absorbing plates in each of the plural sets being arranged such that a first pair of X-ray absorbing plates are opposed to each other and a second pair of X-ray absorbing plates are opposed to each other and perpendicular to each of the first pair of X-ray absorbing plates to define a quadrangular aperture, wherein adjacent plates overlap each other partially at four corners of the aperture, the apertures in the plural sets of X-ray absorbing plates being coaxial and adjacent apertures positioned and increasing in size in an X-ray irradiating direction; and a support device for supporting the plural sets of the plates in such a manner that the plates located on the same sides in the plural sets are supported respectively by the support device throughout the plural sets, the support device coupling each of the plural sets such that the plural sets are configured to be driven in unison.

2. The X-ray diaphragm according to claim 1, wherein the support device are support rods.

3. The X-ray diaphragm according to claim 1, wherein the plural sets of plates are driven by translating the X-ray absorbing plates.

4. The X-ray diaphragm according to claim 3, wherein the X-ray absorbing plates translate to vary a distance between a first X-ray absorbing plate and an opposing second X-ray absorbing plate.

5. The X-ray diaphragm according to claim 3, wherein the X-ray absorbing plates translate to change an angle of an X-ray beam directed though the quadrangular apertures.

6. The X-ray diaphragm according to claim 3, wherein the X-ray absorbing plates translate while maintaining a proportional relationship between each of the quadrangular apertures.

7. The X-ray diaphragm according to claim 1, wherein the overlapping portions of the X-ray absorbing plates are configured to prevent X-ray leakage from the X-ray diaphragm.

8. An X-ray irradiator for radiating X-rays through an X-ray diaphragm and a collimator, the X-rays being generated by an X-ray tube, the X-ray diaphragm comprising:

plural sets of X-ray absorbing plates, each of the plural sets comprising four of said X-ray absorbing plates, the four X-ray absorbing plates in each of the plural sets being arranged such that a first pair of X-ray absorbing plates are opposed to each other and a second pair of X-ray absorbing plates are opposed to each other and perpendicular to each of the first pair of X-ray absorbing plates to define a quadrangular aperture, wherein adjacent plates overlap each other partially at four corners of the aperture, the apertures in the plural sets of X-ray absorbing plates being coaxial and adjacent apertures positioned and increasing in size in an X-ray irradiating direction; and a support device for supporting the plural sets of the plates in such a manner that the plates located on the same sides in the plural sets are supported respectively by the support device throughout the plural sets, the support device coupling each of the plural sets such that the plural sets are configured to be driven in unison.

9. The X-ray irradiator according to claim 8, wherein the support device are support rods.

10. The X-ray irradiator according to claim 8, wherein the plural sets of plates are driven by translating the X-ray absorbing plates.

11. The X-ray irradiator according to claim 10, wherein the X-ray absorbing plates translate to vary a distance between a first X-ray absorbing plate and an opposing second X-ray absorbing plate.

12. The X-ray irradiator according to claim 10, wherein the X-ray absorbing plates translate to change an angle of an X-ray beam directed through the quadrangular apertures.

13. The X-ray irradiator according to claim 10, wherein the X-ray absorbing plates translate while maintaining a proportional relationship between each of the quadrangular apertures.

14. The X-ray irradiator according to claim 8, wherein the overlapping portions of the X-ray absorbing plates are configured to prevent X-ray leakage from the X-ray diaphragm.

15. An X-ray imaging apparatus for photographing a radioscopic image by radiating X-rays to a subject through an X-ray diaphragm and a collimator, the X-rays being generated by an X-ray tube, the X-ray diaphragm comprising:

plural sets of X-ray absorbing plates, each of the plural sets comprising four of said X-ray absorbing plates, the four X-ray absorbing plates in each of the plural sets being arranged such that a first pair of X-ray absorbing plates are opposed to each other and a second pair of X-ray absorbing plates are opposed to each other and perpendicular to each of the first pair of X-ray absorbing plates to define a quadrangular aperture, wherein adjacent plates overlap each other partially at four corners of the aperture, the apertures in the plural sets of X-ray absorbing plates being coaxial and adjacent apertures positioned and increasing in size in an X-ray irradiating direction; and a support device for supporting the plural sets of the plates in such a manner that the plates located on the same sides in the plural sets are supported respectively by the support device throughout the plural sets, the support device coupling each of the plural sets such that the plural sets are configured to be driven in unison.

16. The X-ray imaging apparatus according to claim 15, wherein the support device are support rods.

17. The X-ray imaging apparatus according to claim 15, wherein the plural sets of plates are driven by translating the X-ray absorbing plates.

18. The X-ray imaging apparatus according to claim 17, wherein the X-ray absorbing plates translate to vary a distance between a first X-ray absorbing plate and an opposing second X-ray absorbing plate.

19. The X-ray imaging apparatus according to claim 17, wherein the X-ray absorbing plates translate to change an angle of an X-ray beam directed through the quadrangular apertures.

20. The X-ray imaging apparatus according to claim 17, wherein the X-ray absorbing plates translate while maintaining a proportional relationship between each of the quadrangular apertures.

* * * * *